United States Patent [19]

Nielsen

[11] Patent Number: 4,809,485

[45] Date of Patent: Mar. 7, 1989

[54] ARRANGEMENT FOR THE CONTROL OF THE FLOW OF CONTENTS IN A PACKING MACHINE

[75] Inventor: John E. Nielsen, Karise, Denmark

[73] Assignee: AB Tetra Pak, Lund, Sweden

[21] Appl. No.: 136,272

[22] Filed: Dec. 22, 1987

[30] Foreign Application Priority Data

Dec. 29, 1986 [SE] Sweden ..... 8605577-9

[51] Int. Cl.[4] ..... B65B 1/36; B65B 1/38; B65B 9/08

[52] U.S. Cl. ..... 53/503; 53/551

[58] Field of Search ..... 53/551, 552, 451, 503, 53/504; 141/221, 229, 317

[56] References Cited

U.S. PATENT DOCUMENTS

| | | | |
|---|---|---|---|
| 2,687,740 | 8/1954 | Jarund | 53/503 X |
| 3,020,689 | 2/1962 | Luther | 53/551 X |
| 3,164,936 | 1/1965 | Loliger | 53/551 X |
| 3,269,079 | 8/1966 | Schmied | 53/551 X |
| 3,282,020 | 11/1966 | Smith | 53/551 |
| 3,335,540 | 8/1967 | Reil et al. | 53/551 X |
| 3,470,672 | 10/1969 | Tuma | 53/503 X |
| 3,643,679 | 2/1972 | Hansson . | |
| 3,831,821 | 8/1974 | Doyen | 53/503 X |
| 3,916,598 | 11/1975 | Adams et al. | 53/551 X |
| 4,055,035 | 10/1977 | Sjöstrand et al. . | |
| 4,243,160 | 1/1981 | Reil . | |
| 4,541,463 | 9/1985 | Rausing . | |
| 4,606,174 | 8/1986 | Berg | 53/451 |
| 4,608,810 | 9/1986 | Bordini . | |
| 4,617,779 | 10/1986 | Nygren et al. . | |
| 4,641,486 | 2/1987 | Zannoni | 53/451 X |

*Primary Examiner*—Horace M. Culver

*Attorney, Agent, or Firm*—Burns, Doane, Swecker & Mathis

[57] ABSTRACT

In packing machines of the type which manufacture packing containers from flexible, tubular material, the contents are fed via a filling pipe opens into the tube. The level of contents in the tube is controlled by means of a float which is connected mechanically to a valve located at the mouth of the filling pipe. On filling of highly viscous types of contents, an arrangement for the control of the flow of contents is used instead, in accordance with the invention, which comprises a sealing device surrounding the filling pipe which on the one hand prevents the contents from penetrating upwards into the tube, and which on the other hand is used for controlling the feed of contents in that its vertical position is monitored by means of a monitoring device surrounding the tube and allowed to control a pump for the feed of contents via the filling pipe.

11 Claims, 2 Drawing Sheets

ARRANGEMENT FOR THE CONTROL OF THE FLOW OF CONTENTS IN A PACKING MACHINE

The present invention relates to an arrangement for the control of the flow of contents in a packing machine of the type which fills, cross-seals, and separates packing containers from a substantially vertical tube of flexible packing material into which opens out a filling pipe.

BACKGROUND OF THE INVENTION

It is known that packing containers of the non-returnable type for milk, juice and other liquid foods are manufactured from flexible packing laminate which usually comprises layers of fibrous material, thermoplastics and possibly metal foil. Packing machines which manufacture this type of packing container often use a principle of manufacture which involves the conversion in the first place of the weblike packing material to a liquid-tight tube with a longitudinal sealing joint. This tube extends substantially downwards through the machine and is filled continuously with liquid contents up to a certain predetermined level. Below this predetermined level, a conversion of the filled tube to individual, closed packing containers is carried out with the help of external sealing and forming devices, which packing containers, in the process, become wholly filled with contents. The contents are fed to the tube via a filling pipe extending concentrically through the tube which via valves is connected to a contents reservoir situated above. At the lower end of the filling pipe there is a valve which is joined via a mechanical linkage system to a float arranged around the filling pipe. When the contents flow out into the packing material tube and reach the float, the same is lifted, which means that the valve is closed so that the feed of contents is cut off. This arrangement provides a satisfactory level control in the majority of types of contents up to now, which as a rule are constituted of relatively mobile liquids such as milk, juice, wine or the like. If it is desired to use contents of a higher viscosity, such as cream, ice-cream or butter, however, this arrangement cannot be used, since such contents cannot be fed to the tube through gravity but have to be pumped in and would, moreover, penetrate past the float and prevent the movement of the same as well as cause a cleaning problem. It would be desirable, therefore, to provide an arrangement for the control of the flow of contents in the abovementioned type of packing machines when contents of relatively high viscosity are to be packaged.

OBJECTS AND SUMMARY

It is an object of the present invention to provide an arrangement which overcomes the abovementioned difficulties and which makes it possible to control the direction of the flow of contents as well as the amount of flow.

It is a further object of the present invention to provide an arrangement for the control of the flow of contents to the packing material tube, this arrangement being capable of being used freely together with all types of high-viscosity contents which altogether may be packaged in packing containers of this type.

It is a further object of the present invention to provide an arrangement of the abovementioned type, this arrangement being safe and of a low cost to manufacture and maintain, and moreover, being designed so that it can be applied in a simple manner also to existing types of machines.

These and other objects have been achieved in accordance with the present invention in an arrangement for the control of the flow of contents in a packing machine of the type which fills, cross-seals and separates packing containers from a substantially vertical tube of flexible packing material, into which opens up a filling pipe. The arrangement comprises a movable sealing device, which rests forming a seal against the outside of the filling pipe as well as against the inside of the packing material tube at some distance above the mouth of the filling pipe.

By using in accordance with the invention a movable sealing device liable to be acted upon by the contents, whose vertical position can be monitored from the outside of the packing material tube and is made use of for controlling the feed of contents to the tube, it is ensured on the one hand that the feed of contents at every instant is adapted to requirement, on the other hand that the contents introduced are fed in a downward direction without affecting the elements in the packing material tube regulating the feed.

A preferred embodiment of the arrangement in accordance with the invention will now be described in greater detail with special reference to the attached schematic drawings which only show the details indispensable for an understanding of the invention.

DETAILED DESCRIPTION

Figure 1:
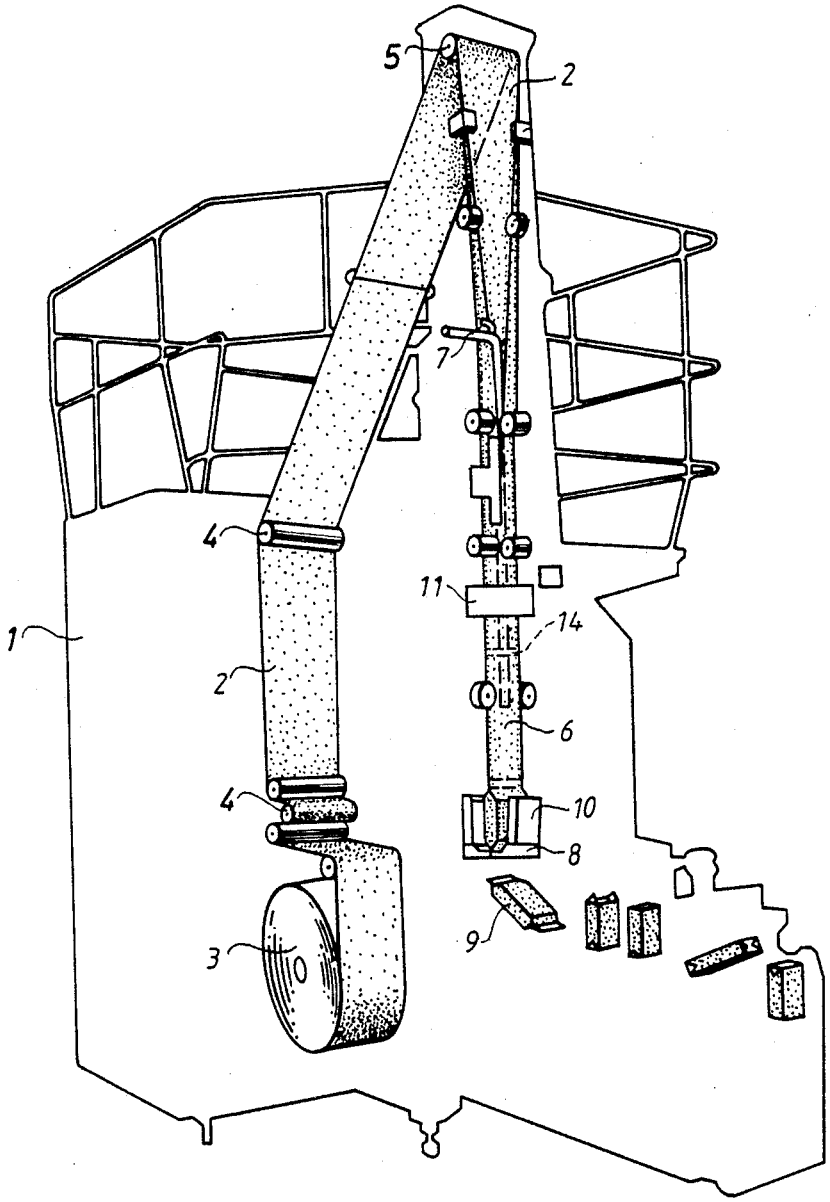
FIG. 1 is a schematic view, partly in cross section, of the path of the packing material through a packing machine during the conversion to finished packing containers.

The packing machine 1 shown in FIG. 1 for the manufacture of non-returnable packages is of the known type to which weblike packing laminate 2 is introduced in the form of a roll 3. The packing laminate 2 comprises layers of paper, thermoplastics, and possibly aluminum foil, and is conducted via a number of deflection rollers 4 up to a deflection roller 5 in the upper part of the machine. Thereafter the web is conducted substantially vertically downwards with simultaneous conversion to a hose or tube 6 which is made liquid-tight through a sealing together of the two longitudinal edges of the laminate web 2 in a liquid-tight longitudinal joint. The packing laminate tube 6 is sealed subsequently in transverse, narrow zones with simultaneous forcing out of the contents by means of co-operating sealing jaws 8 which are moved against each other from opposite sides of the tube, the latter being pressed together and the internal thermoplastic layers lying against each other being made to fuse together through the simultaneous supply of heat. The procedure takes place continuously with the help of two pairs of sealing jaws 8 (only one pair being shown in the Figure) which alternately process the tube during simultaneous downward movement and free the tube during an upward return movement. After the sealing together and the division of the material tube caused thereby into individual, closed packing containers 9, the packing containers are separated from one another by means of cuts in the compressed and sealed zones.

In connection with the transverse sealing of the tube, a certain reshaping of the same takes place, so that it is converted from its original, substantially circular cross-sectional shape to a more rectangular cross-sectional shape. This is done with the help of shaping jaws 10 joined together with the sealing jaws 8 which compress the tube from two sides so that the same is given the desired shape. After separation of the individual, filled and sealed packing containers 9 from one another, a further form-processing of the individual packing containers is generally also carried out, so that they obtain a desired final shape, e.g. parallelepipedic.

Beside the machine components described above, the packing machine also comprises a number of conventional elements such as rollers and guides for the guiding and forming of the packing material tube, hot air nozzles for the sealing of the longitudinal joint and feed pipes and ducts for various functions known in themselves which are of no significance to the invention and which, therefore, are not described in more detail.

In FIG. 1 is also shown a level monitoring device 11, which is located around the packing material tube 6 at some distance above the point where with the help of the jaws 8, the tube 6 it is provided with transverse seals. Inside the monitoring device 11 in the packing material tube 6 is located a part of the arrangement in accordance with the invention, which together with associated components situated outside the packing material tube 6, is shown schematicaly in FIG. 2 on a larger scale and partly in cross section.

Figure 2:
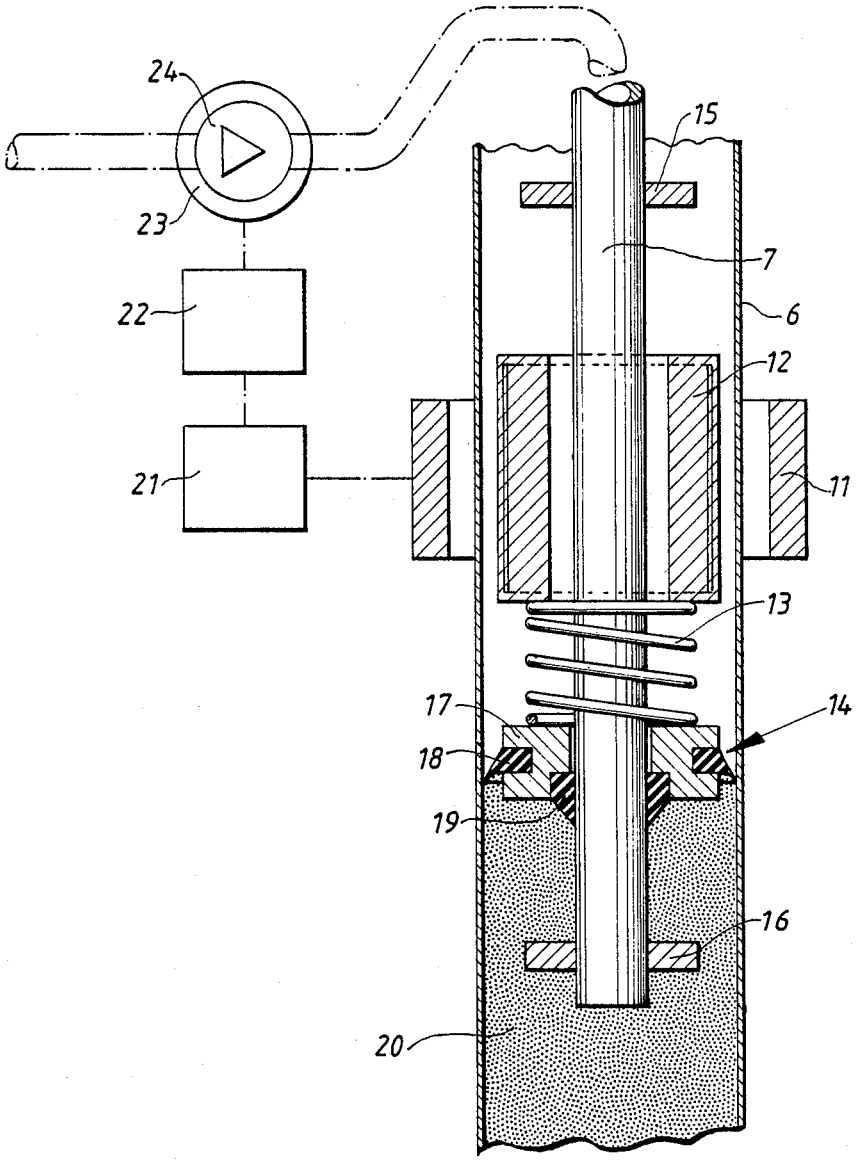
FIG. 2 is a larger scale view, partly in cross section, of a part of a packing material tube with the arrangement in accordance with the present invention.

The part of the packing material tube 6 illustrated in FIG. 2 is surrounded, as has been mentioned earlier, by a level monitoring device 11 which is firmly joined to the machine frame (not shown) on a suitable level above the point where the packing material tube is reshaped with the help of the sealing jaws 8 and the shaping jaws 10. On substantially the same level as the monitoring device 11 a cylinder 12 is located inside the packing material tube. The cylinder is connected by means of a helical compression spring 13 to a sealing device 14 situated at a lower level. The cylinder 12, the spring 13 and the sealing device 14 are arranged concentrically in relation to the filling pipe 7 as well as to the monitoring device 11 and are vertically movable between an upper stopping device 15 and a lower stopping device 16 which is carried by the filling pipe 7. The lower stopping device 16 is located at a slight distance above the mouth of the filling pipe 7, whereas the upper stopping device 15 is situated slightly below the point at which the longitudinal joint of the packing material tube is completed. The cylinder 12 comprises a layer of $\mu$-metal (that is, material of high permeability), whose position is adapted so as to be monitored electrically by the device 11, which will be explained more fully below. The sealing device 14 comprises a plate 17, on the outer periphery of which a downwards directed lip seal 18 is pressed against the inner surface of the packing material tube 6. The plate 17 has a central hole of a diameter slightly larger than the outside diameter of the filling pipe 7 and a seal 19 located in the hole which is in the form of a lip seal resting against the outer surface of the filling pipe 7. The space in the packing material tube 6 is divided by the sealing device 14 into a lower part, which during operation of the machine is filled with contents 20, and an upper part which communicates with the surrounding atmosphere via the upper open end of the packing material tube.

The firmly fixed level monitoring device 11 extending around the packing material tube 6 includes two coil windings (not shown in the Figure) arranged vertically on top of one another. The coil windings are joined to a level controller 21 of a conventional type which, depending on the vertical position of the cylinder 12, monitored by the level monitoring device 11, gives a signal to a likewise conventional frequency converter 22. The frequency converter 22 controls the speed of rotation of an electric motor 23, which is directly connected to, and is adapted to drive, a gear pump 24, by means of which gear pump 24, the product is fed through the filling pipe 7. The pump 24 is connected to a contents reservoir (not shown) and its delivery side is connected, as indicated, to the upper end of the filling pipe 7.

On operation of the packing machine shown with the arrangement in accordance with the invention the particular contents, e.g. butter (temperature approx. 14° C., pumping pressure approx. 3 bar), are pumped by the pump 24 from a contents reservoir (not shown), via the filling pipe 7 into the lower end of the packing material tube 6, where the level rises until the contents make contact with the sealing device 14 and commence to lift the same. The cylinder 12 is also lifted thereby so that an ever increasing part of the area of $\mu$-metal of the cylinder 12 will be surrounded by the level monitoring device 11 which by means of the two coils (not shown) located on top of one another monitors the position of the cylinder 12 as a difference signal which is fed to the level controller 21. When the cylinder 12 has reached a predetermined, upper limit position the level controller 21 gives, via the frequency converter 22, a signal to the motor 23 to lower the speed of the pump 24 so that the feed of contents via the filling pipe 7 is reduced. Since the packing machine continues to form and separate filled packing containers at the lower end of the packing material tube 6, the sealing device 14 and with it the cylinder 12 will gently move downwards again in the packing material tube 6 (partly depending on the friction between the seal 18 and the downward trending tube wall, partly depending on its weight), which results in a change in the output signal from the level monitoring device 11 which via the level controller 21 and the frequency converter 22 causes the motor 23 to increase its speed, so that the flow of contents to the packing material tube 6 via the filling pipe 7 is again increased so that the sealing device 14 is lifted and the procedure is repeated.

The two limit positions can be adjusted, of course, as desired, but in order to prevent damage to the components present in the packing material tube through excessively great movement, e.g. through pressure surges in the contents which may be caused by the pressing together and forming of the lower end of the packing material tube 6, the movement of the sealing device 14 and of the cylinder 12 is limited with the help of the two mechanical stopping devices 15 and 16. To prevent rupture of the packing material tube owing to the upward movement of the sealing device 14 being checked suddenly through mechanical contact with the stopping device 15 and consequent pressure surge, the spring 13 is located between the cylinder 12 and the sealing device 14 which means that the upward movement of the sealing device 14 is succesively braked so that the risk of tube bursting is reduced.

In certain types of packaging machines or combinations of certain kinds or amounts of filling goods, it may also be possible to use a more simple kind of control, which functions as a pure on/off-control. In order not to cause excessively great pressure variations the two limit positions must be comparatively close together, so that the adjustment occurs frequently and in small steps.

Although only one preferred embodiment is specifically illustrated and described herein, it will be appreciated that many modifications and variations of the present invention are possible in light of the above teachings and within the purview of the appended claims without departing from the spirit and intended scope of the invention.

I claim:

1. An arrangement for the control of the flow of contents in a packing machine of the type which fills, seals and separates packing containers from a substantially vertical tube of flexible packing material, into which tube opens up a filling pipe, said arrangement comprising:

a movable sealing device which forms a seal against the outside of the filling pipe as well as against the inside of the packing material tube at some distance above the mouth of the filling pipe.

2. The arrangement in accordance with claim 1, wherein the filling pipe, the movable sealing device, and the packing material tube are arranged substantially concentric in relation to each other.

3. The arrangement in accordance with claim 1, wherein the sealing device is vertically movable between two end positions which are defined by two stopping devices joined to the filling tube.

4. The arrangement in accordance with claim 3, wherein the sealing device is connected via a helical spring to a cylinder located above the sealing device, the vertical position of the cylinder being adapted to be monitored by means of a level monitoring device for the control of the feed of contents situated outside the tube.

5. The arrangement in accordance with claim 4, wherein the cylinder comprises an area of $\mu$-metal, the vertical position of which cylinder is adapted to be monitored by means of the level monitoring device, which surrounds the packing material tube and whose signal controls a pump for the feed of contents to the packing material tube.

6. The arrangement in accordance with claim 1, wherein the sealing device is in the form of a plate provided with a central hole which surrounds the filling pipe and has flexible seals resting against the inside of the packing material tube and the outside of the filling pipe respectively.

7. An arrangement for controlling the flow of contents in a packing machine of the type that fills, seals, and separates packing containers by feeding the contents into a continuous tube of flexible packing material from a feed tube arranged within the continuous tube of packing material, comprising:

a movable seal arranged in a sealing manner between the outside of the feed tube and the inside of the continuous tube of packing material;

said seal being adapted to float on the upper level of the contents within the continuous tube of packing material;

means mounted outside the continuous tube of packing material for monitoring the level of the contents within the continuous tube of packing material; and means mounted on the movable seal for initiating the monitoring means to emit a flow controlling signal when the level of the contents reaches a predetermined level.

8. The arrangement in accordance with claim 7, wherein the initiating means includes a cylinder of high permeability material mounted on top of said movable seal.

9. The arrangement in accordance with claim 8, further comprising a spring separating the cylinder from the movable seal.

10. The arrangement in accordance with claim 7, further comprising stops mounted on the feed tube for limiting movement of the movable seal within the continuous tube of packing material.

11. The arrangement in accordance with claim 9, further comprising stops mounted on the feed tube for limiting movement of the movable seal within the continuous tube of packing material.

* * * * *